US007454848B2

(12) United States Patent
Issler

(10) Patent No.: US 7,454,848 B2
(45) Date of Patent: Nov. 25, 2008

(54) SHOE WITH IMPROVED CONSTRUCTION

(75) Inventor: James E. Issler, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 587 days.

(21) Appl. No.: 11/018,585

(22) Filed: Dec. 21, 2004

(65) Prior Publication Data

US 2006/0130360 A1 Jun. 22, 2006

(51) Int. Cl.
*A43B 13/28* (2006.01)
*A43D 11/00* (2006.01)

(52) U.S. Cl. ..... 36/12; 36/22 R; 36/18; 12/142 C; 12/142 T

(58) Field of Classification Search ..... 36/19 R, 36/19 A, 18, 22 R, 22 A, 12; D2/977; 12/142 B, 12/142 C, 142 T
See application file for complete search history.

(56) References Cited

U.S. PATENT DOCUMENTS 2,040,459 A * 5/1936 Bagshaw ..... 112/34
D100,140 S * 6/1936 Buek, Jr. ..... D2/977
2,119,392 A * 5/1938 Levin ..... 36/12
2,330,459 A * 9/1943 Tweedie ..... 112/413
2,427,023 A * 9/1947 Schwartz ..... 36/19.5
2,820,308 A * 1/1958 Hiestand ..... 36/9 R
6,834,444 B2 * 12/2004 Issler ..... 36/12
6,966,128 B2 * 11/2005 McClaskie ..... 36/12
6,976,320 B2 * 12/2005 McClaskie ..... 36/11.5

* cited by examiner

*Primary Examiner*—Jila M Mohandesi
(74) *Attorney, Agent, or Firm*—St. Onge Steward Johnston & Reens LLC

(57) ABSTRACT

The invention relates to a shoe having an outsole with an inside surface and an outside surface. The shoe also has an upper placed above the inside surface and a stitch that extends through the upper and the outsole for securing the upper and outsole together, wherein the stitch also extends from the outside surface to the upper in generally alternating diagonal directions so that the stitch intersects itself.

18 Claims, 5 Drawing Sheets

SHOE WITH IMPROVED CONSTRUCTION

FIELD OF THE INVENTION

The invention relates to a shoe having improved construction and, more particularly, a shoe having an outsole sewn to an upper employing unique stitching.

BACKGROUND OF THE INVENTION

There are a wide variety of shoe constructions. One construction method, known as Opanka construction, includes sewing, often by hand, the outsole to the upper of the shoe along an outer periphery of the outsole.

Referring to FIGS. 1-3, a prior art Opanka shoe construction is shown. The shoe 10 includes outsole 12 being secured to the upper 14 by threads 16 that pass through a plurality of aligning holes in both outsole 12 and upper 14. FIG. 1 shows a perspective view of upper 14 where the top of threads 16 is depicted.

FIG. 2 shows a cross sectional view of the shoe shown in FIG. 1. As shown, threads 16 pass through both upper 14 and outsole 12 from top to bottom and vice versa. To prevent threads 16 from being worn due to walking, thereby prolonging the life of threads and keeping outsole 12 secured to upper 14, the shoe includes a channel 18 to protect threads 16. Without channel 18, threads 16 may fail at a quicker rate and cause outsole 12 to separate from upper 14.

However, channel 18 may not prevent all objects, especially small rocks, dirt, or debris, from entering channel 18 and damaging threads 16. Additionally, having an outsole that shows both channel and threads 16 may detract from the appearance of the shoe.

In FIG. 3, an alternative prior art embodiment of the Opanka construction shoe shown in FIG. 1, is shown having channel 20 on a side of outsole 12. In this fashion, one may argue that less debris or dirt will penetrate channel 20 due to its position on a side of outsole 12 as opposed to the bottom of outsole 12, as shown in FIG. 2. However, one may also argue that channel 20 is more visible on the side of the shoe as opposed to the bottom of the shoe and that the utilitarian benefits of placing channel 20 on the side is offset by the unattractiveness of making channel 20 more visible.

What is desired, therefore, is a shoe having an improved construction. Another desire is to provide a shoe that uses stitching for securing the outsole to the upper in a more aesthetically pleasing manner without sacrificing strength or structural integrity of the shoe. A further desire is to provide a shoe with improved Opanka stitching.

SUMMARY OF THE INVENTION

It is, therefore, an object of the invention to provide a shoe with improved construction without sacrificing strength or structural integrity.

Another desire is a shoe that employs a stitch in an aesthetically pleasing manner.

These and other objects of the invention are achieved by a shoe having an outsole with an inside surface and an outside surface. The shoe also has an upper placed above the inside surface and a stitch that extends through the upper and the outsole for securing the upper and outsole together, wherein the stitch also extends from the outside surface to the upper in generally alternating diagonal directions so that the stitch intersects itself.

The stitch may intersect itself so that it indicates a shape of an X. The stitch may cyclically repeat the stitching pattern so that a plurality of X shapes are provided. In some embodiments, the stitch is a continuous length of material. In other embodiments, the stitch includes at least two lengths of different materials.

The above mentioned generally alternating diagonal directions are diagonal relative to a line of contact between said upper and said outsole.

Optionally, the outsole includes a lip extending around a localized area of a periphery of the outsole. The outsole may also have a side wall extending around a periphery of the outsole and a channel in the side wall extending around a localized area of the periphery. In some of these embodiments, the stitch extends from the channel to the upper in generally alternating diagonal directions relative to a line of contact between the upper and the lip.

In another aspect of the invention, the shoe may have a socklining placed between and in contact with both the inside surface of the outsole and the upper, the socklining adapted to receive a user's foot. The stitch, therefore, extends through the upper, socklining, and outsole for securing the upper, socklining, and outsole together. The stitch also extends from the outside surface to the upper in generally alternating diagonal directions wherein the stitch intersects itself.

In a further aspect of the shoe, the upper has a top left hole, a top right hole, and a top right most hole. The outsole has a bottom left hole and a bottom right hole. The upper is secured above the outsole by a stitch extending along the following path: along the outside surfaces of the outsole and upper from the bottom left hole to the top right hole; along the inside surfaces of the upper and outsole from the top right hole to the bottom right hole; along the outside surfaces of the outsole and upper from the bottom right hole to the top left hole; along the inside surfaces of the upper and outsole from the top left hole to the bottom right hole; and along the outside surfaces of the outsole and upper from the bottom right hole to the top right most hole.

The stitch extending along the outside surfaces of the outsole and upper from the top right hole to the bottom left hole may pass underneath or over the stitch extending along the outside surfaces of the outsole and upper from the top left hole to the bottom right hole.

Optionally, a cushion may be placed between the socklining and outsole for enhancing comfort to the user.

DETAILED DESCRIPTION OF THE DRAWINGS

Figure 1:
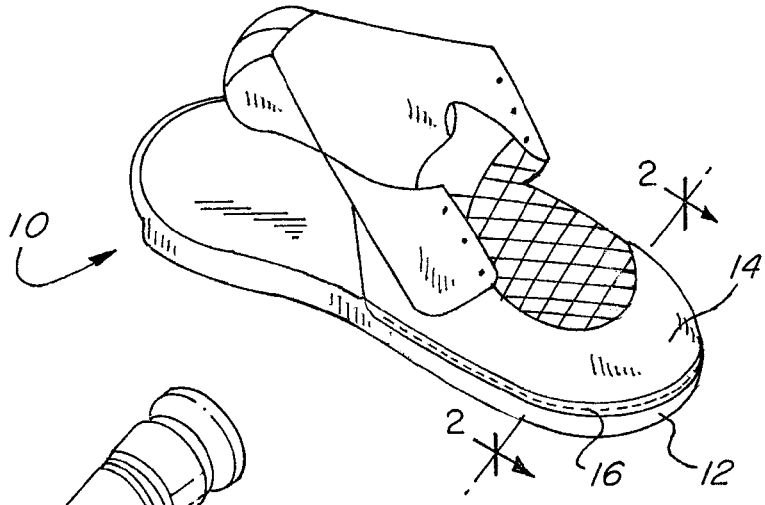
FIG. 1 (PRIOR ART)
FIGS. 1-3 depict the prior art.
Figure 2:
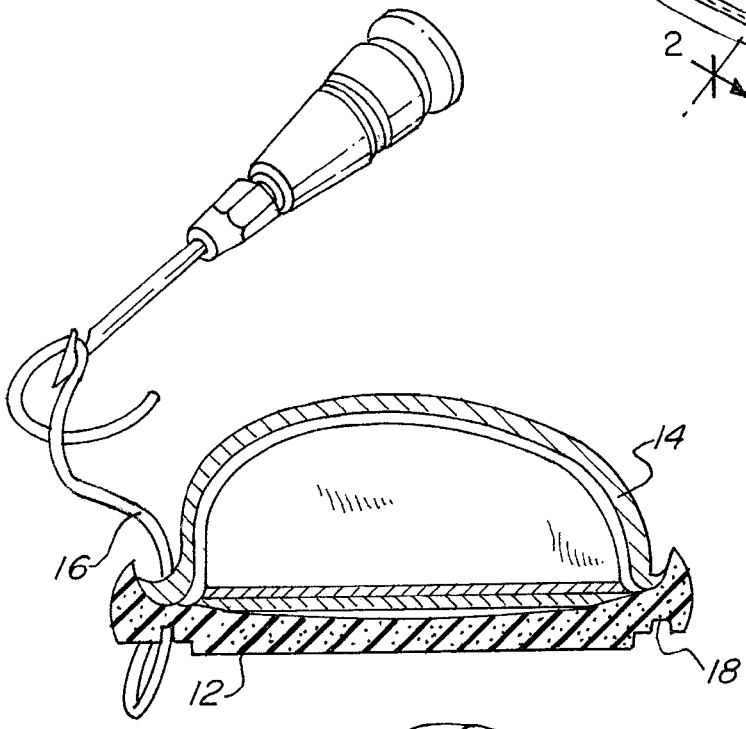
FIG. 2 (PRIOR ART)
Figure 3:
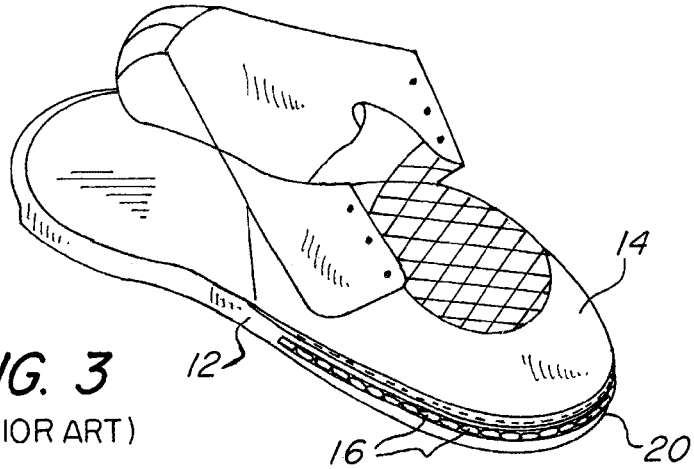
FIG. 3 (PRIOR ART)
Figure 4:
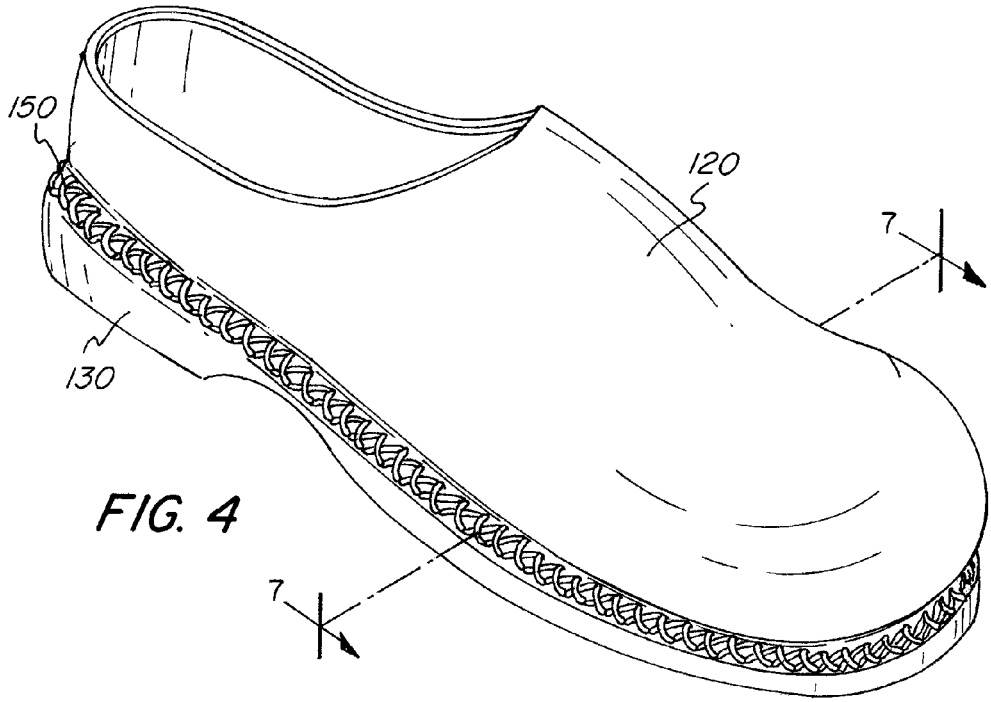
FIG. 4 depicts the shoe in accordance with the invention.
Figure 5:
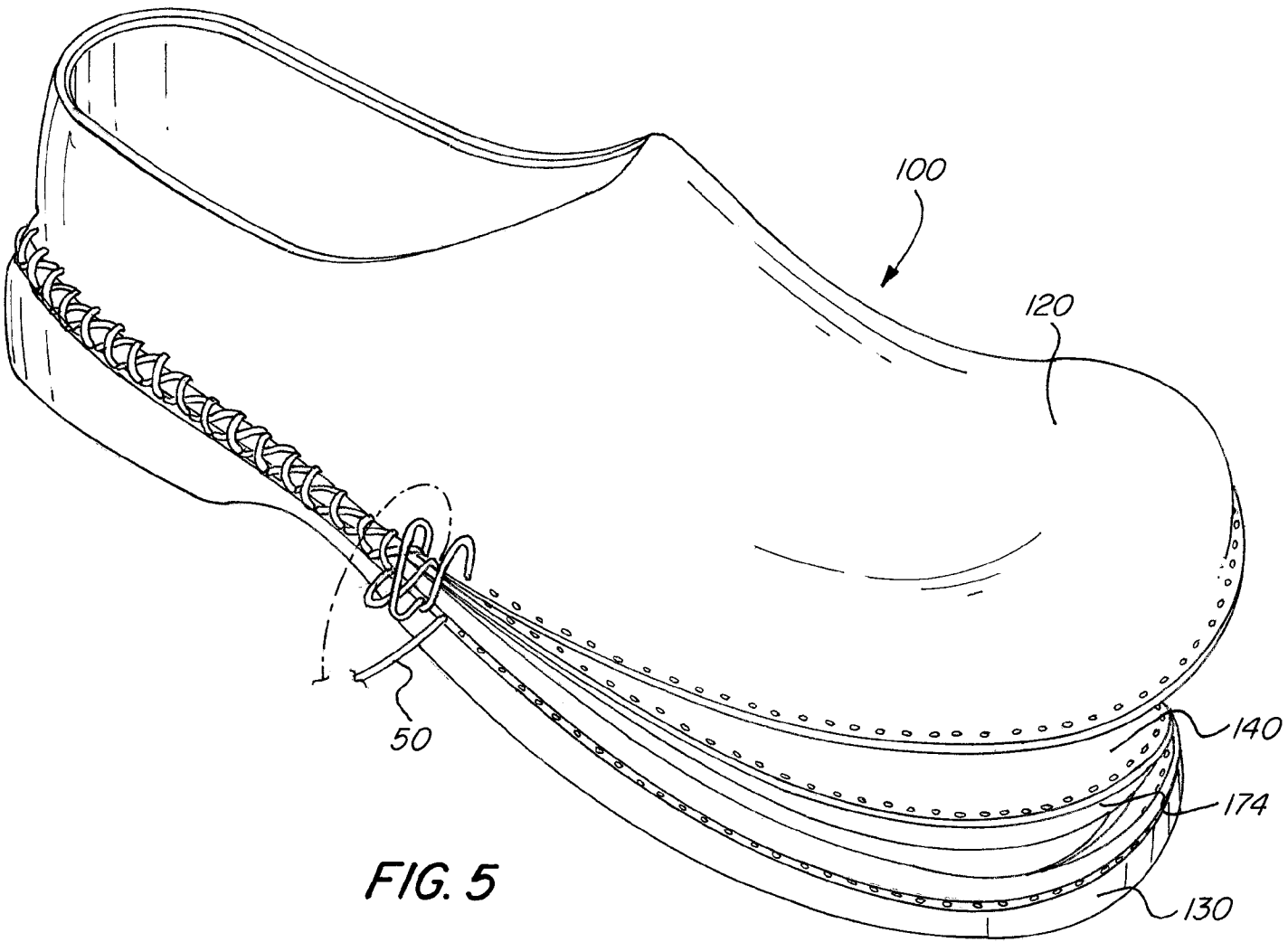
FIG. 5 depicts an assembly view of the shoe shown in FIG. 4.

FIGS. 4 and 5 depict shoe 100 in accordance with the invention. As shown, shoe 100 includes upper 120, outsole 130, socklining 140, and stitch 50 used to secure upper 120, outsole 130, and socklining 140 together.

Figure 6:
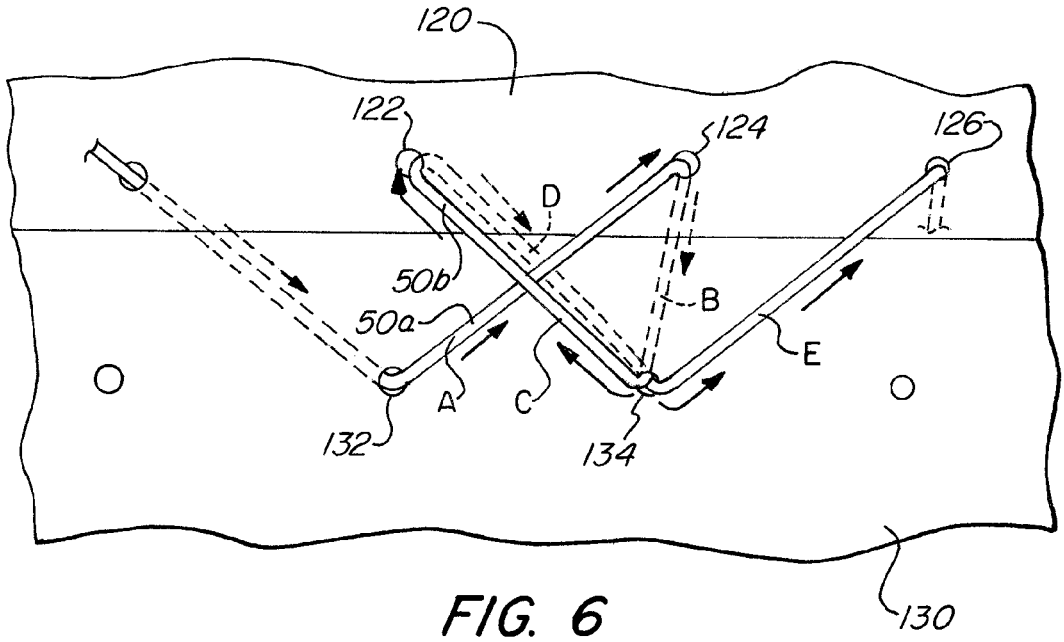
FIG. 6 depicts a close up view of the stitching shown in FIG. 4.

As shown more particularly in FIG. 6, stitch 50 extends from outsole 130 to upper 120 in generally alternating diagonal directions wherein stitch 50 intersects itself. To more easily describe the generally alternating diagonal directions, or where stitch 50 intersects itself, stitch 50 is shown to have a first extension 50*a* and second extension 50*b* and where first extension 50*a* is shown to cross with, or intersect, second extension 50*b*. First extension 50*a* and second extension 50*b* together indicate the shape of an X.

Further, first extension 50*a* and second extension 50*b* intersect one another in cyclical fashion so that a plurality of Xs are provided. As shown, first extension 50*a* and second extension 50*b* cyclically intersect one another. Moreover, first extension 50*a* is shown to pass beneath second extension 50*b*. However, this is not required as second extension 50*b* may pass under first extension 50*a*. All that is required is for stitch 50 to intersect itself to indicate the shape of an X and first extension 50*a* may pass over second extension 50*b*.

It should be known that first and second extensions 50*a*, 50*b* are preferably both of a single continuous length of material. A single continuous length is defined by first extension 50*a* and second extension 50*b* being connected to each other to indicate at least one X. All that is required is for stitch 50 to intersect itself to indicate a shape of an X. In further embodiments, stitch 50 is of at least two separable lengths of material wherein first extension 50*a* may be separable from, or formed from a different length of material than, second extension 50*b*. In these embodiments, each extension 50*a* and 50*b* may be continuous lengths of material. Continuous lengths of material are defined to mean first extension 50*a* is a single unit of material and second extension 50*b* is a single unit of material, where both extensions define at least one X.

Figure 7:
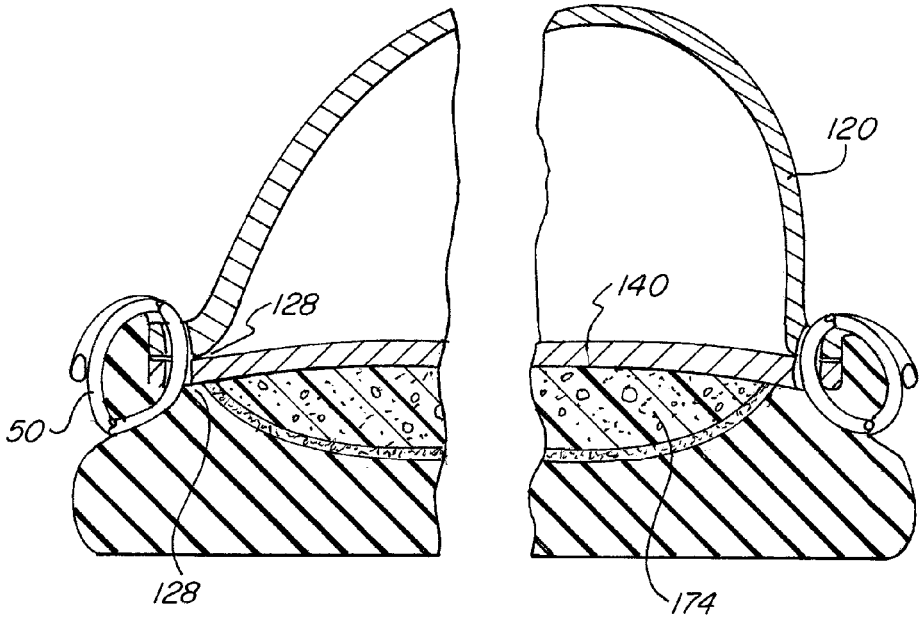
FIG. 7 depicts a cross sectional view along the line 7-7 shown in FIG. 4.

A generally diagonal direction is defined to be any non-parallel direction relative to line 128 of contact between upper 120 and socklining 140 or socklining and outsole 130. See FIG. 7. Hence, provided stitch 50, first extension 50*a*, or second extension 50*b* does not extend in a direction parallel with line 128 of contact, it would be generally diagonal. Generally alternating diagonal directions include at least a first direction extending in a non-parallel relationship with line 128 of contact and at least a second direction extending in a non-parallel relationship with line 128 of contact, where the at least first and second directions are also non-parallel to each other. Because the at least first and second directions are non-parallel with line 128 and with each other, they invariably intersect.

To more particularly describe stitch 50 and the generally alternating diagonal directions, stitch 50 is shown to extend in and out of apertures that extend from inside surface 137 of outsole 130 to outside surface 139 as well as from inside surface 127 of upper 120 to outside surface 129.

As shown, upper 120 includes top left hole 122, top right hole 124, and top right most hole 126. Outsole 130 includes bottom left hole 132 and bottom right hole 134.

Stitch 50 extends in generally alternating diagonal directions to secure upper 120 to outsole 130 by the following pattern: along the outside surfaces of the outsole and upper from the bottom left hole 132 to the top right hole 124 (indicated as item A); along the inside surfaces of the upper and outsole from the top right hole 124 to the bottom right hole 134 (indicated as item B); along the outside surfaces of the outsole and upper from the bottom right hole 134 to the top left hole 122 (indicated as item C); and along the inside surfaces of the upper and outsole from the top left hole 122 to the bottom right hole 134 (indicated as item D). The cycle then repeats beginning by extending along the outside surfaces of the outsole and upper from the bottom right hole 134 to the top right most hole 126 (indicated as item E). Item E is equivalent to item A.

Figure 8:
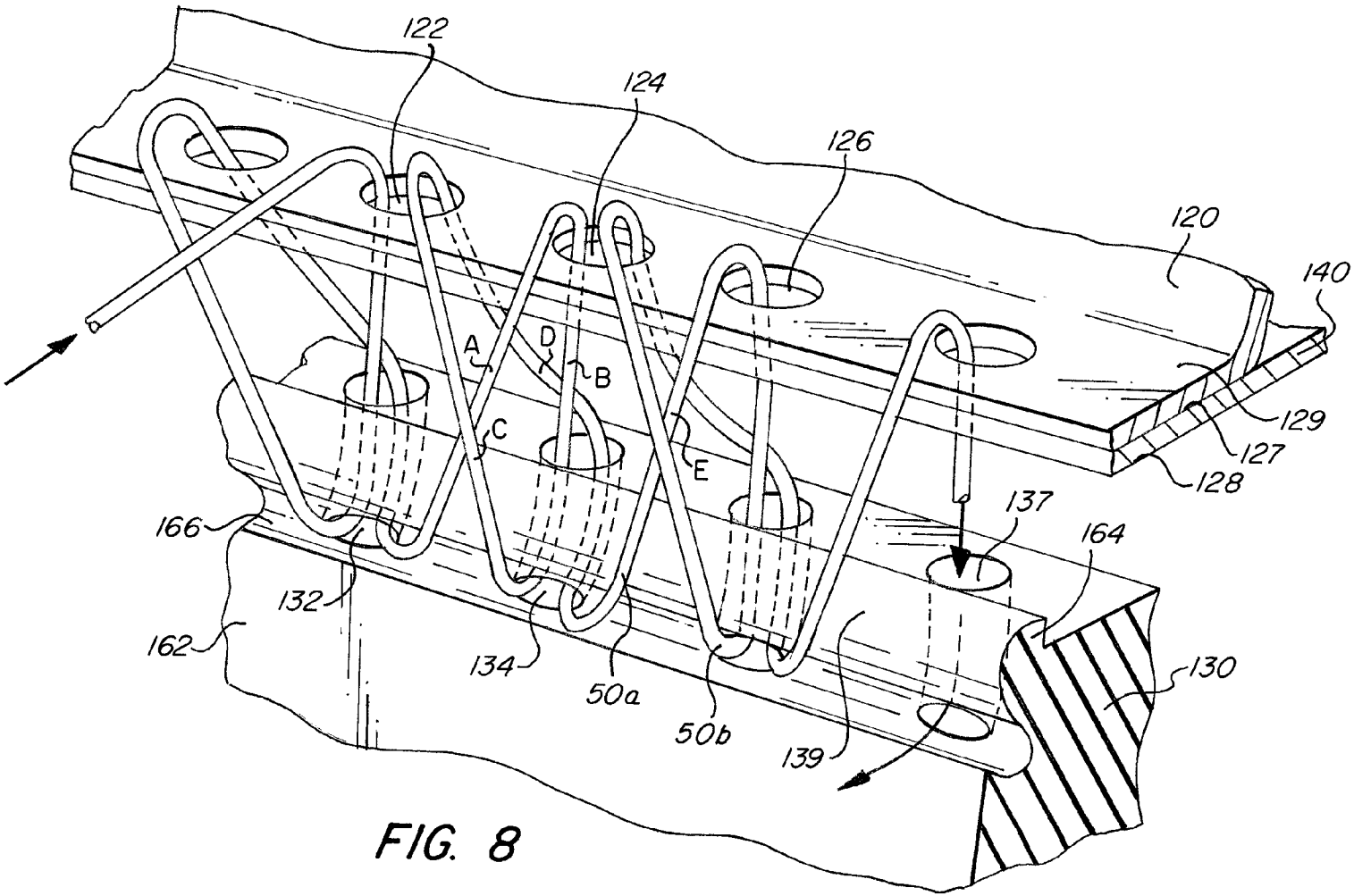
FIG. 8 depicts a further embodiment of the invention shown in FIG. 4.

In the embodiment, shown in FIG. 8, outsole 130 includes sidewall 162, lip 164 extending around a localized area of a periphery of outsole 130, and channel 166. In these embodiments, stitch 50 extends from channel 166 to upper 120, together with inside and outside surfaces as described above, in the same manner as described above for generally alternating diagonal directions for securing upper 120 to outsole 130.

It should be noted that socklining 140 placed between inside surface 137 of outsole 130 and upper 120 is optional and is used to receive a user's foot. Hence, socklining 140 is usually of a soft, smooth and/or comfortable material, such as leather, vinyl, and the like.

Beneath socklining 140 may be cushion 174 for enhancing comfort to shoe 100. Cushion 174 is any foam, rubber, gel, composite, or likewise soft material that absorbs shock or impact.

What is claimed is:

1. A shoe, comprising:

an outsole having an inside surface and an outside surface;

an upper placed above said inside surface;

a stitch extending through said upper and said outsole for securing said upper and said outsole together;

said stitch also extending from said outside surface to said upper in generally alternating diagonal directions wherein said stitch intersects itself;

wherein said outsole includes a lip extending around a localized area of a periphery;

wherein said outsole has a side wall extending around a periphery of said outsole and a channel in said side wall extending around a localized area of the periphery; and wherein the stitch extends from the channel to the upper.

2. The shoe according to claim 1, wherein said stitch extends from said outside surface to said upper in generally alternating diagonal directions to indicate a shape of an X.

3. The shoe according to claim 1, wherein said stitch is a continuous length of material.

4. The shoe according to claim 1, wherein said stitch cyclically extends from said outside surface to said upper in generally alternating diagonal directions where said stitch cyclically intersects itself to indicate a plurality of X shapes.

5. The shoe according to claim 1, wherein said stitch extends from said outside surface to said upper in generally alternating diagonal directions relative to a line of contact between said upper and said outsole.

6. The shoe according to claim 1, wherein said stitch extends from said channel to said upper in generally alternating diagonal directions relative to a line of contact between said upper and said lip.

7. A shoe, comprising:

an outsole having an inside surface and an outside surface;

an upper having an inside surface and an outside surface;

said upper is placed above said outsole;

said upper has a top left hole and a top right hole;

said outsole has a bottom left hole and a bottom right hole; and a stitch for securing said upper to said outsole having the following pattern:

said stitch extending along said outside surface of said outsole and said outside surface of said upper from said bottom left hole to said top right hole;

said stitch extending along said inside surface of said upper and said inside surface of said outsole from said top right hole to said bottom right hole;

said stitch extending along said outside surface of said outsole and said outside surface of said upper from said bottom right hole to said top left hole; and p2 said stitch extending along said inside surface of said upper and said inside surface of said outsole from said top left hole to said bottom right hole.

8. The shoe according to claim 7, wherein said stitch extending along said outside surface of said outsole and said outside surface of said upper from said bottom left hole to said top right hole passes underneath said stitch extending along said outside surface of said outsole and said outside surface of said upper from said bottom right hole to said top left hole.

9. The shoe according to claim 7, wherein the patterns for said stitch cyclically repeats.

10. The shoe according to claim 7, further comprising a socklining placed between said upper and said outsole.

11. The shoe according to claim 7, further comprising a cushion placed between said socklining and said outsole.

12. The shoe according to claim 7, wherein said stitch extends from said outside surface to said upper in generally alternating diagonal directions to indicate a shape of an X.

13. The shoe according to claim 7, wherein said stitch is a continuous length of material.

14. The shoe according to claim 7, wherein said stitch cyclically extends from said outside surface to said upper in generally alternating diagonal directions where said stitch cyclically intersects itself to indicate a plurality of X shapes.

15. The shoe according to claim 7, wherein said stitch extends from said outside surface to said upper in generally alternating diagonal directions relative to a line of contact between said upper and said outsole.

16. The shoe according to claim 7, wherein said outsole includes a lip extending around a localized area of a periphery.

17. The shoe according to claim 16, wherein said outsole has a side wall extending around a periphery of said outsole and a channel in said side wall extending around a localized area of the periphery.

18. The shoe according to claim 17, wherein said stitch extends from said channel to said upper in generally alternating diagonal directions relative to a line of contact between said upper and said lip.

* * * * *